United States Patent [19]

Tanaka et al.

[11] Patent Number: 4,583,326

[45] Date of Patent: Apr. 22, 1986

[54] ABRADING MACHINE FOR ABRADING A WELDED SEAM IN AN ELONGATED WORKPIECE

[75] Inventors: Kikuo Tanaka, Ono; Isomi Washio, Odawara, both of Japan

[73] Assignee: Amada Company, Limited, Japan

[21] Appl. No.: 761,668

[22] Filed: Aug. 1, 1985

Related U.S. Application Data

[63] Continuation of Ser. No. 589,995, Mar. 15, 1984, abandoned.

[51] Int. Cl.[4] ..... B24B 21/00

[52] U.S. Cl. ..... 51/81 R; 51/98.5; 51/102; 51/135 R; 51/140; 51/324

[58] Field of Search ..... 51/72 R, 80 R, 81 R, 51/81 BS, 98.5, 102, 92 R, 109 R, 111 R, 116, 125.5, 135 R, 140, 143, 165.75, 231, 234, 238 R, 324, 326, DIG. 15

[56] References Cited

U.S. PATENT DOCUMENTS

| | | | |
|---|---|---|---|
| 1,475,367 | 11/1923 | Boulter | 51/140 |
| 2,052,837 | 9/1936 | Makaroff | 51/92 R X |
| 2,097,068 | 10/1937 | Johnson | 51/92 R |
| 2,404,917 | 7/1946 | Murdock | 51/140 |
| 2,830,413 | 4/1958 | Dahlerup | 51/92 R |
| 3,232,159 | 2/1966 | Stanley | 51/216 R X |
| 3,656,263 | 4/1972 | Jacobsen | 51/238 R |
| 3,902,283 | 9/1975 | Bean | 51/165.75 X |

*Primary Examiner*—Robert P. Olszewski

*Attorney, Agent, or Firm*—Wigman & Cohen

[57] ABSTRACT

The present invention relates to an abrading machine comprising two abrading devices, a carrier member that is provided between the two abrading devices so as to be movable toward and away from them. Gripping elements are mounted on the carrier member so as to be located on opposite sides of the abrading devices to hold a workpiece to be abraded. A plurality of supporting members are also provided on the carrier member to rotatably swing up and down in order to support the workpiece as it is abraded by the different abrading devices. The gripping elements are pivotably attached to the carrier member and are designed to swing with respect to the carrier member in the direction of movement of the carrier member.

6 Claims, 3 Drawing Figures

ABRADING MACHINE FOR ABRADING A WELDED SEAM IN AN ELONGATED WORKPIECE

This application is a continuation of application Ser. No. 589,995, filed Mar. 15, 1984, now abandoned.

BACKGROUND OF THE INVENTION

1. Field of the Invention

The present invention relates to an abrading machine for abrading an elongated workpiece such as a bandsaw blade, and more particularly to an abrading machine which can be used to abrade smoothly, for example, a welded seam of a bandsaw blade, ends of which have been butt welded into an endless shape by a welder such as a flash butt welder.

2. Description of the Prior Art

It is necessary to abrade, for instance, welded seams of bandsaw blades into smooth surfaces since bandsaw blades are butt welded at their ends into endless shapes or loops by the use of a welder such as a flash butt welder. Heretofore, it has been customary that a welded seam of a bandsaw blade is abraded by hand by the use of a grinding wheel in a manner such that one side of the bandsaw blade is first abraded by the upper side of the grinding wheel and then the other side thereof is abraded by the lower side of the grinding wheel. Accordingly, it has been troublesome and time-consuming to abrade bandsaw blades and also it has been difficult to abrade both sides of a bandsaw blade evenly into a smooth finish since the upper and lower sides of the bandsaw blade are not presented from the same angle during abrasion. Also, it has been very inconvenient that the finishes of abraded bandsaw blades vary according to the skill of those who perform these jobs with the result that bandsaw blades are uneven and differ in cutting performance. For example, there has been a tendency for some bandsaw blades to be excessively pressed onto the grinding wheel and thus to have concavities are formed at their welded seams, which are subject to stress concentration. Furthermore, it has been disadvantageous that bandsaw blades have a tendency to be unevenly or concavely abraded by the grinding wheel which has a peripheral grinding surface being small in radius of curvature.

SUMMARY OF THE INVENTION

It is a general object of the present invention to provide an abrading machine which can be used to abrade safely and automatically a portion of an elongated workpiece such as a welded seam of a bandsaw blade, ends of which have been butt welded into an endless state.

It is another object of the present invention to provide an abrading machine which is capable of widely abrading a wide portion of an elongated workpiece such as a welded seam of a bandsaw blade into a smooth surface.

It is another object of the present invention to provide an abrading machine which raises the quality and productivity in abrasion of elongated workpieces such as bandsaw blades In order to attain these objects, an abrading machine according to the present invention is provided with a pair of upper and lower abrasive means for abrading an elongated workpiece and a carrier means which is automatically operated to enable the abrasive means to abrade such a workpiece. The carrier means is automatically vertically movable toward and away from the abrasive means and is provided with a pair of gripping means for gripping the workpiece and a supporting means for supporting the workpiece being abraded. The gripping means are so arranged as to be not only vertically moved by the carrier member but also be automatically swung to bring the workpiece into abrading contact with the abrasive means. The supporting means is also so arranged as to be not only vertically moved by the carrier member but also be automatically rotated to support the workpiece being abraded by the abrasive means.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENT

Figure 1:
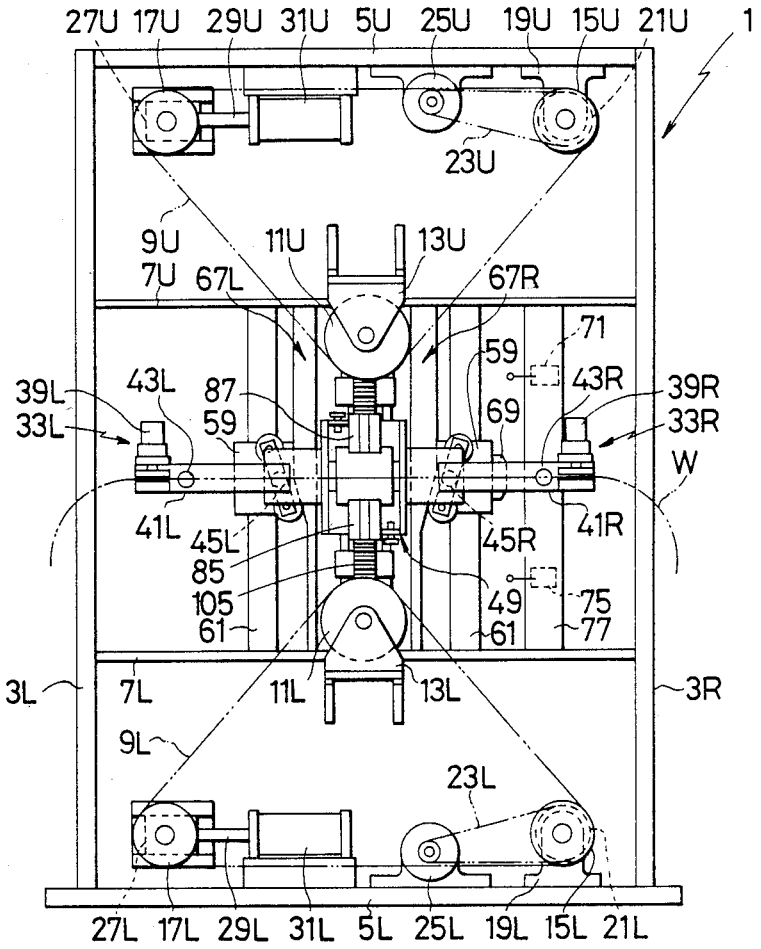
FIG. 1 is a front elevational view of an abrading machine embodying the principles of the present invention.

Referring to FIG. 1, the abrading machine 1 according to the present invention is of a box-like structure which consists of side frames 3R and 3L vertically disposed in parallel with each other and upper and lower frames 5U and 5L horizontally provided at the top and bottom, respectively, of the side frames 3R and 3L. Also, there are provided a pair of cross plates 7U and 7L which are horizontally fixed between the side frames 3R and 3L in parallel with each other.

Figure 2:
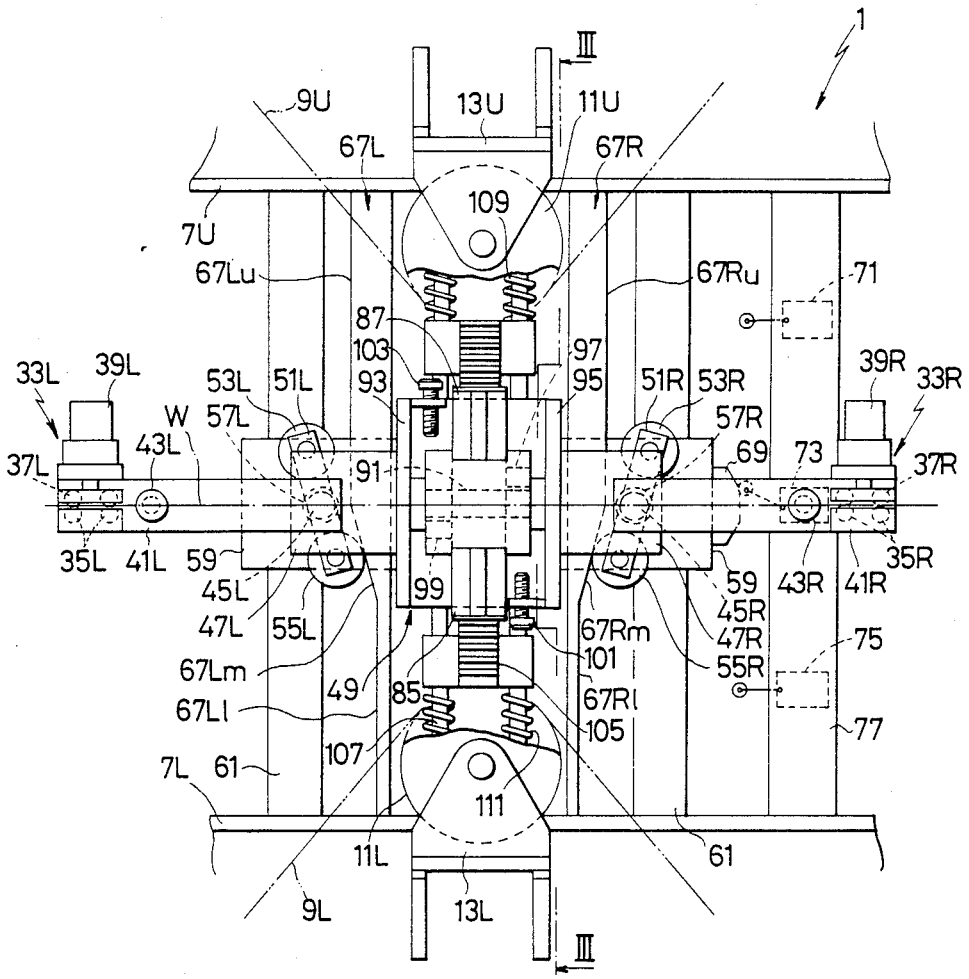
FIG. 2 is a front elevational view showing, by an enlarged scale, the major portion of the abrading machine shown in FIG. 1.

As shown in FIGS. 1 and 2, the abrading machine 1 is provided with a pair of upper and lower abrasive belts 9U and 9L to abrade an elongated workpiece W such as a bandsaw blade which is held at the central portion of the abrading machine 1 in a manner to be described in great detail hereinafter. The upper and lower abrasive belts 9U and 9L are trained on a pair of upper and lower contact wheels 11U and 11L, respectively, which are freely rotatably mounted on the upper and lower cross plates 7U and 7L, respectively, by means of brackets 13U and 13L, respectively. The upper and lower contact wheels 11U and 11L are vertically symmetrically disposed on the upper and lower cross plates 7U and 7L, respectively, with their axes horizontal in vertical alignment with each other so as to hold the upper and lower abrasive belts 9U and 9L in vertical alignment with each other. Also, the upper and lower abrasive belts 9U and 9L are further trained around driving wheels 15U and 15L, respectively, and also tension wheels 17U and 17L, respectively, as shown in FIG. 1.

The driving wheels 15U and 15L are freely rotatably mounted on the upper and lower frames 5U and 5L, respectively, by means of brackets 19U and 19L, respectively, together with pulleys 21U and 21L, respectively, in coaxial relationship therewith. The pulleys 21U and 21L are connected by belts 23U and 23L, respectively, to electric motors 25U and 25L, respectively, which are mounted on the upper and lower frames 5U and 5L, respectively, to drive the driving wheels 15U and 15L, respectively. In the preferred embodiment, the driving wheels 15U and 15L are vertically symmetrically disposed at the right-hand ends of the upper and lower frames 5U and 5L, respectively, and the electic motors 25U and 25L are mounted at the inner portions thereof. In this connection, it will be understood that the driving wheels 15U and 15L can be so arranged as to be driven by a single motor by use of a suitable transmitting means, although the two electric motors 25U and 25L are employed in the preferred embodiment.

The tension wheels 17U and 17L are freely rotatably disposed on holding means 27U and 27L, respectively, which are fixed to piston rods 29U and 29L of hydraulic or pneumatic motors 31U and 31L, respectively. The hydraulic or pneumatic motors 31U and 31L are mounted on the upper and lower frames 5U and 5L, respectively, in such a manner as to enable the piston rods 29U and 29L, respectively, to tension the upper and lower abrasive belts 9U and 9L, respectively, through the tension wheels 17U and 17L, respectively. In the preferred embodiment, the tension wheels 17U and 17L are vertically symmetrically provided at the left-hand ends of the upper and lower frames 5U and 5L, respectively.

In the above described arrangement, the upper and lower abrasive belts 9U and 9L will be driven by the driving wheels 15U and 15L, respectively, to be rotated or run on the upper and lower wheels 11U and 11L, respectively, when the electric motors 25U and 25L are put in motion. Also, the upper and lower abrasive belts 9U and 9L will be kept tensioned by the tension wheels 17U and 17L, respectively, when the hydraulic or pneumatic motors 31U and 31L are actuated to keep the piston rods 29U and 29L, respectively, outwardly biased. Thus, it will be understood that the workpiece W can be abraded by the upper and lower abrasive belts 9U and 9L being rotated on the upper and lower contact wheels 11U and 11L when it is brought into contact therewith.

As shown also in FIGS. 1 and 2, in order to hold the workpiece W to be abraded between the upper and lower abrasive belts 9U and 9L, a pair of gripping means 33R and 33L are provided between the upper and lower cross plates 7U and 7L. The gripping means 33R and 33L comprise a plurality of holding rollers 35R and 35L, a plurality of pressing rollers 37R and 37L and hydraulic or pneumatic motors 39R and 39L, respectively. Also, the gripping means 33R and 33L are mounted on ends of swing arms 41R and 41L, respectively, on which stopper means 43R and 43L, respectively, are provided so that the workpiece W can be aligned therewith so as to be positioned to be gripped. The holding rollers 35R and 35L and the pressing rollers 37R and 37L are disposed in alignment with one another to cooperate with one another to grip the workpiece W in a manner such that the workpiece W can be moved lengthwise therebetween. Also, the pressing rollers 37R and 37L are so arranged as to be pressed onto the holding rollers 35R and 35L, respectively, by the hydraulic or pneumatic motors 39R and 39L, respectively, to grip the workpiece W in cooperation with the holding rollers 35R and 35L. Thus, the workpiece W to be abraded is gripped by the gripping means 33R and 33L just under the upper contact wheel 11U and just above the lower contact wheel 11L in contact with the stopper means 43R and 43L so that it may be moved lengthwise between the holding and pressing rollers 35R and 37R and between the holding and pressing rollers 35L and 37L.

The swing arms 41R and 41L holding the gripping means 33R and 33L, respectively, are fixed at their ends to pins 45R and 45L, respetively, which are pivotally and horizontally disposed on brackets 47R and 47L, respectively, provided on a carrier 49. The pins 45R and 45L are so arranged as to be rotated on the carrier 49 by links 51R and 51L, respectively, to swing the swing arms 41R and 41L and the gripping means 33R and 33L, respectively, so as to vertically move the workpiece W into contact with the upper and lower abrasive belts 9U and 9L. The links 51R and 51L are integrally fixed to the rear ends of the pins 45R and 45L, respectively, provided with upper cam followers 53R and 53L, respectively, at their upper ends and also lower cam followers 55R and 55L, respectively, at their lower ends to rotate the pins 45R and 45L, respectively, in a manner to be described in detail hereinafter. Also, for a purpose to be seen hereinafter, the swing arms 41R and 41L are kept biased by springs 57R and 57L, respectively, so that the lower cam followers 55R and 55L will be kept inwardly biased about the axes of the pins 45R and 45L, respectively. Thus, the swing arms 41R and 41L will be swung by the pins 45R and 45L, respectively, when the links 51R and 51L are moved by the upper cam followers 53R and 53L and the lower cam followers 55R and 55L, respectively. Also, when the swing arms 41R and 41L are swung, the gripping means 33R and 33L will be swung to vertically move the workpiece W into contact with the upper and lower abrasive belts 9U and 9L.

The carrier 49, on which the brackets 47R and 47L are fixed to hold the pins 45R and 45L, respectively, are vertically movably mounted by means of slide blocks 59 on a plurality of guide posts 61 which are vertically fixed between the upper and lower cross plates 7U and 7L. In order to vertically move the carrier 49 on the guide posts 61, a hydraulic or pneumatic motor 63 is mounted on the lower cross plate 7L with its piston rod 65 connected to the underside of the carrier 49. Thus, the carrier 49 is vertically moved on the guide posts 61 by the hydraulic or pneumatic motor 63 to enable the gripping means 33R and 33L to move the workpiece W up and down into contact with the upper and lower abrasive belts 9U and 9L. As will be further described hereinafter, the carrier 49 is raised to enable the upper abrasive belt 9U to abrade the upper side of the workpiece W, and it is lowered to enable the lower abrasive belt 9L to abrade the lower side of the same.

The links 51R and 51L are so arranged as to be moved by the upper cam followers 53R and 53L and the lower cam followers 55R and 55L, respectively, to rotate the pins 45R and 45L, respectively, according to the vertical position of the carrier 49 on the guide posts 61. For this purpose, a pair of elongated cam members 67R and 67L are symmetrically provided on the opposite sides of the carrier 49 and vertically fixed between the upper and lower cross plates 7U and 7L so that the upper cam followers 53R and 53L and the lower cam followers 55R and 55L may be in contact therewith. Stated otherwise, the upper cam followers 53R and 53L and the lower cam followers 55R and 55L are so disposed as to roll up and down on the cam members 67R and 67L, respectively, when the carrier 49 is vertically moved on the guide posts 61 by the hydraulic or pneumatic motor 63. The cam members 67R and 67L are provided with upper protruded cam surfaces 67Ru and 67Lu, midway sloped cam surfaces 67Rm and 67Lm and lower recessed cam surfaces 67Rl and 67Ll, respectively, all of which are straight and continuous so that the upper cam followers 53R and 53L and the lower cam followers 55R and 55L may be rolled thereon. The arrangement is such that the upper cam followers 53R and 53L and the lower cam followers 55R and 55L, when rolled along the cam members 67R and 67L by the carrier 49, will move the links 51R and 51L to cause the pins 45R and 45L to swing the swing arms 41R and 41L and the gripping means 33R and 33L. Also, the midway sloped cam surfaces 67Rm and 67Lm of the cam members 67R and 67L are so designed that the swing arms 41R and 41L will be kept horizontal with the lower cam followers 55R and 55L in contact with the midway sloped cam surfaces 67Rm and 67Lm when the carrier 49 is at its midway position on the guide posts 61 as shown in FIG. 1 and 2. In this connection, the lower cam followers 55R and 55L will be always kept in contact with the cam members 67R and 67L even when the upper cam followers 53R and 53L are out of contact therewith, since the springs 57R and 57L are provided to inwardly bias the lower cam followers 55R and 55L as has been described.

In the above described arrangement, the swing arms 41R and 41L will be kept horizontal to hold the workpiece W horizontal when the carrier 49 is located at the midway position on the guide posts 61 as shown in FIGS. 1 and 2. In this state, the lower cam followers 55R and 55L will be kept in contact with the midway sloped.cam surfaces 67Rm and 67Lm of the cam members 67R and 67L, respectively, by the action of the springs 57R and 57L, respectively, while the upper cam followers 53R and 53L will be kept out of contact with the upper protruded cam surfaces 67Ru and 67Lu, respectively. When the carrier 49 is raised by the hydraulic or pneumatic motor 63 from the position shown in FIGS. 1 and 2 to move the lower cam followers 55R and 55L from the midway sloped cam surfaces 67Rm and 67Lm onto the upper protruded cam surfaces 67Ru and 67Lu, the links 51R and 51L will be moved to rotate the pins 45R and 45L and the gripping means 33R and 33L. Thus, when the carrier 49 is raised from the position shown in FIGS. 1 and 2, the gripping means 33R and 33L will be not only upwardly moved by the carrier 49 but also will be swung upwardly by the swing arms 41R and 41L about the axes of the pins 45R and 45L to raise and bend the workpiece W. As will be readily understood, the workpiece W will be downwardly bent when the gripping means 33R and 33L are swung by the swing arms 41R and 41L, since the workpiece W is gripped between the holding rollers 35R and 35L and the pressing rollers 37R and 37L in the gripping means 35R and 35L so that it may be lengthwise moved therebetween. Thus, when the carrier 49 is raised, the workpiece W will be upwardly moved or fed by the gripping means 33R and 33L in its downwardly bent or curved state to bring its upper side into abrading contact with the upper abrasive belt 9U which is trained on the upper contact wheel 11U in a somewhat semicircular state. To the contrary, the links 51R and 51L will rotate the pins 45R and 45L to downwardly swing the swing arms 41R and 41L and the gripping means 33R and 33L when the carrier 49 is lowered from the position shown in FIG. 1 and 2. Of course, the gripping means 33R and 33L will be not only lowered by the carrier 49 but also will be swung downwardly by the swing arms 41R and 41L to lower and bend the workpiece W, when the carrier 49 is lowered from the position shown in FIGS. 1 and 2. Also, it will be understood that the workpiece W will be downwardly fed by the gripping means 33R and 33L in its upwardly bent state to bring its lower side into abrading contact with the lower abrasive belt 9L which is trained on the lower contact wheel 11L in a somewhat semicircular state. As shown in FIGS. 1 and 2, in order to control the vertical movement of the carrier 49, a dog member 69 is provided on a portion of the carrier 49, and detecting means 71, 73 and 75 such as limit switches are so disposed as to be contacted by the dog member 69 when the carrier 49 is moved on the guide posts 61. In the preferred embodiment, the dog member 69 is provided on one of the slide blocks 59, and the detecting means 71, 73 and 75 are mounted on a post 77 which is vertically disposed between the upper and lower cross plates 7U and 7L. The detecting means 71, 73 and 75 are disposed at three positions on the post 77 different in height in such a manner as to be adjusted in height. The arrangement is such that the position of the carrier 49 on the guide posts 61 is detected to control the hydraulic or pneumatic motor 63 moving the carrier 49 when the detecting means 71, 73 and 75 are contacted by the dog member 69. More particularly, the detecting means 71 and 75 are so arranged as to be contacted by the dog member 69 and stop and return the carrier 49 to cause the gripping means 33R and 33L to bring the workpiece W into abrading contact with the upper and lower abrasive belts 9U and 9L, respectively. Also, the detecting means 73 is so arranged as to be contacted by the dog member 69 and stop the carrier 49 as soon as the carrier 49 has been returned from its lower travelling limit to the original midway position shown in FIGS. 1 and 2. Thus, the carrier 49 is first raised from the original midway position shown in FIGS. 1 and 2 to enable the upper abrasive belt 9U to abrade the workpiece W and then is lowered to enable the lower abrasive belt 9L to abrade the workpiece W and is lastly raised again to be stopped at the original midway position for the next cycle of abrading.

Figure 3:
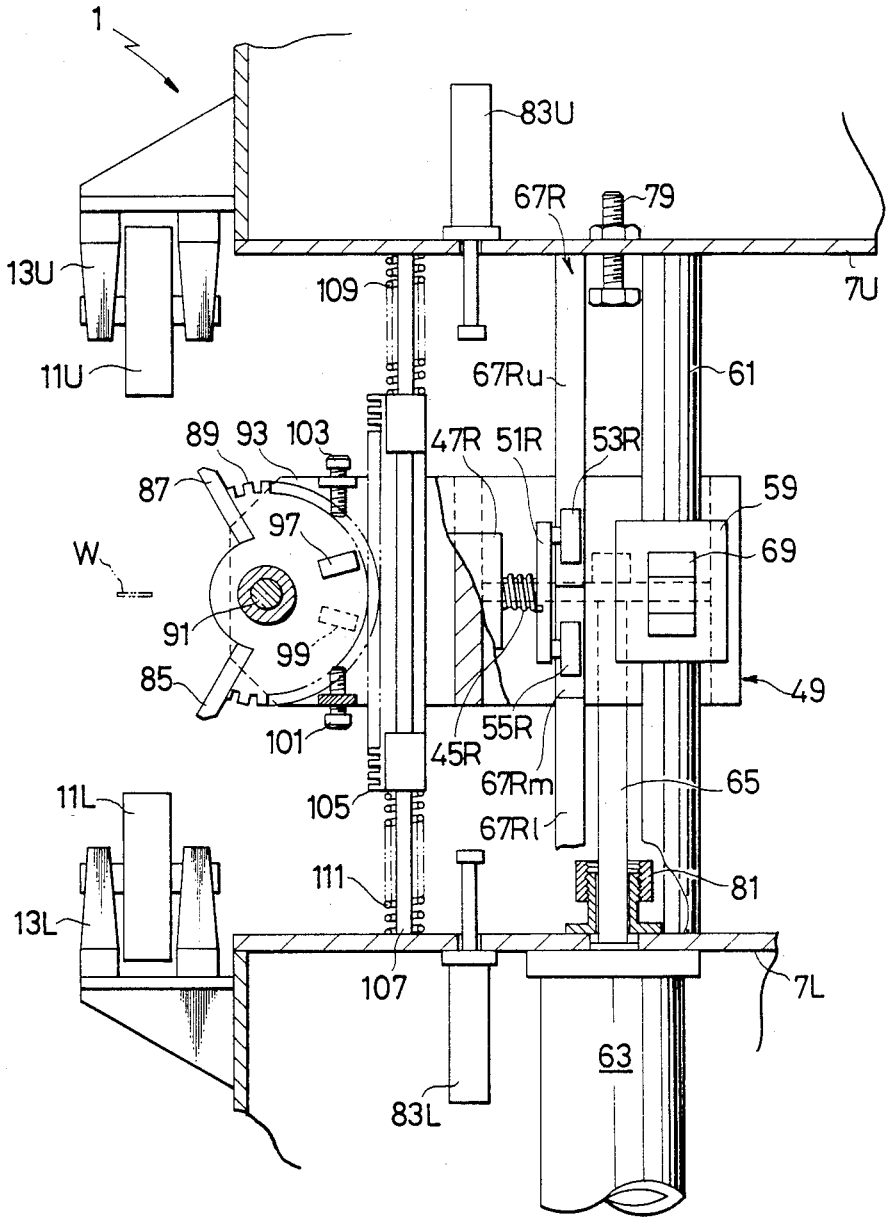
FIG. 3 is a sectional view taken along the line III—III of FIG. 2.

As shown in FIG. 3, in order to limit the vertical movement of the carrier 49 on the guide posts 61, an adjusting bolt 79 and an adjusting nut 81 are provided on the upper and lower cross plates 7U and 7L, respectively, so that they may stop the carrier 49. Also, cushion dampers 83U and 83L are provided on the upper and lower cross plates 7U and 7L, respectively, so as to stop softly the carrier 49 from travelling on the guide posts 61 when contacted thereby. Thus, the carrier 49, when moving to enable the gripping means 33R and 33L to bring the workpiece W into abrading contact with the upper and lower abrasive belts 9U and 9L, will be first slowed down by the cushion dampers 83U and 83L and then firmly stopped by the adjusting bolt 79 and the adjusting nut 81 from moving to be returned. In this connection, the detecting means 71 and 75 will act to electrically stop and return the carrier 49 after the contact of the carrier 49 with the cushion dampers 83U and 83L and before or on that with the adjusting bolt 79 and the adjusting nut 81. Also, the adjusting bolt 79 and the the adjusting nut 81 are adjusted to adjust the abrading amounts of the workpiece W by the upper and lower abrasive belts 9U and 9L, respectively.

As best shown in FIGS. 2 and 3, there are provided a pair of supporting members 85 and 87 which are integrally fixed to a sector gear 89 so as to support the workpiece W which is being abraded by the abrasive belts 9U and 9L. The supporting members 85 and 87 are of a square-shaped plate and are symmetrically fixed to the peripheral ends of the sector gear 89 in such a manner as to radially project beyond the periphery therof. The sector gear 89 is rotatably supported by a horizontal shaft 91 between a pair of brackets 93 and 95 which are fixed to the front face of the carrier 49 in parallel with each other so that the sector gear 89 may be vertically moved together with the carrier 49. The sector gear 89 is so disposed that it can be rotated to hold the supporting members 85 and 87 horizontal just beneath and above the abrasive belts 9U and 9L, respectively. Stated otherwise, the sector gear 89 can bring the supporting members 85 and 87 into contact with the abrasive belts 9U and 9L, respectively, in their horizontal state when the carrier 49 is raised and lowered on the guide posts 61. In order to stop the sector gear 89 from rotating when the supporting members 85 and 87 are horizontal, a pair of stopping members 97 and 99 are fixed to the opposite sides of the sector gear 89 and a pair of bolts 101 and 103 are provided on the inner sides of the brackets 93 and 95, respectively. Of course, the stopping members 97 and 99 are so disposed on the sector gear 89 as to go into contact with the bolts 101 and 103, respectively, to stop the sector gear 89 from rotating when the supporting members 85 and 87, respectively, have become horizontal. Thus, the supporting members 85 and 87 can be held horizontal by the sector gear 89 and can be carried by the carrier 49 in their horizontal state to support the workpiece W which is being abraded by the abrasive belts 9U and 9L.

As shown in FIG. 3, an elongated rack member 105 is vertically provided in engagement with the sector gear 89 so as to rotate the same on the shaft 91 when the carrier 49 is vertically moved on the guide posts 61. The rack member 105 is vertically movably mounted on a guide bar 107 which is vertically fixed between the upper and lower cross plates 7U and 7L, and it is resiliently held at the midway on the guide bar 107 by helical springs 109 and 111 surrounding the same. Thus, when the carrier 49 is moved on the guide posts 61, the sector gear 89 will be rotated by the rack member 109 until the stopping members 97 and 99 are brought into contact with the bolts 101 and 103, respectively, and the supporting members 85 and 87 are made horizontal. Also, after having been stopped from rotating with the supporting members 85 and 87 horizontal, the sector gear 89 will be further raised or lowered by the carrier 49 together with the rack member 105 against the springs 109 and 111 to bring the supporting members 85 an 87 toward the upper and lower abrasive belts 9U and 9L in their horizontal state. In this arrangement, the supporting members 85 and 87 will be raised and lowered by the sector gear 89 in their horizontal state to support the workpiece W when the carrier 49 is raised and lowered to enable the upper and lower abrasive belts 9U and 9L to abrade the workpiece W.

In operation, the workpiece W is initially gripped horizontally by the gripping means 33R and 33L in contact with the stopper means 43R and 43L and then the hydraulic or pneumatic motor 63 is put in motion to raise the carrier 49 along the guide posts 61. As the carrier 49 is raised from the original position shown in FIGS. 1 and 2, the gripping means 33R and 33L will be upwardly swung by the swing arms 41R and 41L to raise and bend the workpiece and the sector gear 89 will be rotated to make the supporting member 85 horizontal. When the carrier 49 is further raised to be slowed down by the cushion damper 83U, the gripping means 33R and 33L will bring the upper side of the workpiece W in its downwardly bent state into abrading contact with the upper abrasive belt 9U and the supporting member 85 will be brought into contact with the workpiece W to support the same. As soon as the upper side of the workpiece W has been abraded, the carrier 49 will be stopped from rising and returned downwardly by the action of the detecting means 71 with the result that the gripping means 33R and 33L and the supporting member 85 will be returned to their original position together with the workpiece W. When the carrier 49 is further lowered beyond the original position shown in FIGS. 1 and 2, the gripping means 33R and 33L will be downwardly swung to bring the lower side of the workpiece W into abrading contact with the lower abrasive belt 9L and the supporting member 87 will be lowered in its horizontal state to support the workpiece W. As soon as the lower side of the workpiece W has been abraded, the carrier 49 will be stopped from lowering and raised by the action of the detecting means 75 and then will be stopped by the action of the detecting means 73 at the original position for the next cycle of abrading.

As has been described in the above, the workpiece W can be safely and automatically abraded into an even and smooth finish by use of the abrading machine according to the present invention. Since the workpiece W is abraded by the wide abrasive belts 9U and 9L which are trained on the contact wheels 11U and 11L larger in radius of curvature, it is evenly and smoothly finished without the conventional disadvantage that workpieces are unevenly or concavely abraded by a grinding wheel having a peripheral grinding surface of small radius of curvature. Thus, the abrading machine according to the present invention is able to raise the quality and productivity in abrasion of elongated workpieces such as bandsaw blades.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. An abrading machine, comprising:

two abrading means;

a carrier member so provided the abrading means as to be movable toward and away from the abrading means;

gripping means for holding a workpiece:

means for supporting the gripping means mounted on the carrier member so as to be located on opposite sides of the abrading means;

workpiece supporting means provided on the carrier member to support the workpiece being abraded; and means for pivotally swinging the gripping means supporting means with respect to the carrier member in the direction of movement of the carrier member as the carrier member is moved toward and away from the abrading means.

2. The abrading machine according to claim 1, wherein the swinging means include cam surfaces and cam followers.

3. An abrading machine, comprising:

abrading means;

a carrier member so provided as to be movable toward and away from the abrading means;

workpiece supporting means rotatably provided on the carrier member to support a workpiece being abraded by the abrading means;

gripping means for holding the workpiece;

means for supporting the gripping means swingably provided on opposite sides of the abrading means; and the workpiece supporting means and the gripping means supporting means being so arranged as to move with respect to the movement of the carrier member toward and away from the abrading means as the carrier member is moved toward and away from the abrading means.

4. The abrading machine according to claim 3, further comprising cam surfaces and cam followers for swinging the gripping means.

5. An abrading machine, comprising:

a pair of abrading means symmetrically provided;

a carrier member movably mounted between the abrading means to move toward and away from the abrading means;

a pair of supporting surfaces on a rotatable supporting means mounted on the carrier member so as to rotate in response to movement of the carrier member for alternately supporting opposite sides of a workpiece being abraded by the abrading means;

gripping means swingably provided on the carrier member located on opposite sides of the abrading means to hold the workpiece to be abraded; and a plurality of detecting means provided to detect the carrier member coming close to the abrading means and to detect the carrier being located approximately at the midway between the abrading means.

6. An abrading machine, comprising:

two abrading means;

a carrier member provided between the abrading means so as to be movable between the abrading means;

gripping means located on the carrier member for gripping a workpiece to be abraded;

first and second detecting means located on opposite sides of the carrier member for limiting movement of the carrier member;

means for moving the carrier member toward one of the abrading means until it hits one of the detecting means;

means for moving the carrier member toward the other of the abrading means until it hits the other of the detecting means; and two support means rotatably mounted to the carrier member so that one of the support members supports a first surface of the workpiece and the other of the support member supports a second surface of the workpiece when the respective surfaces are being abraded.

* * * * *